US008087094B2

(12) United States Patent
Karasina

(10) Patent No.: US 8,087,094 B2
(45) Date of Patent: Jan. 3, 2012

(54) SHIRT HAVING FORM-FITTING MID-SECTION SUPPORT

(76) Inventor: Svetlana Karasina, Basking Ridge, NJ (US)

( * ) Notice: Subject to any disclaimer, the term of this patent is extended or adjusted under 35 U.S.C. 154(b) by 1421 days.

(21) Appl. No.: 11/638,293

(22) Filed: Dec. 12, 2006

(65) Prior Publication Data

US 2008/0134409 A1 Jun. 12, 2008

(51) Int. Cl.
*A41B 1/00* (2006.01)

(52) U.S. Cl. ..... 2/77; 2/115

(58) Field of Classification Search ..... 2/77, 104, 2/106, 107, 113, 114, 115, 117, 274, 69, 2/67; 602/60, 61, 75; 128/873, 874, 875; 450/30

See application file for complete search history.

(56) References Cited

U.S. PATENT DOCUMENTS

| | | | | | |
|---|---|---|---|---|---|
| 432,442 | A | | 7/1890 | Sanford | 2/113 |
| 1,380,605 | A | | 6/1921 | Swantees | 2/115 |
| 2,199,442 | A | * | 5/1940 | Mayonnade et al. | 450/8 |
| 2,352,128 | A | * | 6/1944 | Shikles, Jr. | 2/77 |
| 2,456,190 | A | | 12/1948 | Heilbronner | 2/90 |
| 2,609,541 | A | * | 9/1952 | Kaplan | 2/116 |
| 3,707,973 | A | * | 1/1973 | Welsch et al. | 450/109 |
| 4,065,814 | A | | 1/1978 | Fox | 2/79 |
| 5,431,030 | A | * | 7/1995 | Ishizaki et al. | 66/176 |
| 5,996,120 | A | * | 12/1999 | Balit | 2/67 |
| 6,053,852 | A | | 4/2000 | Wilkinson | 482/127 |
| 6,061,832 | A | * | 5/2000 | Morrison, Jr. | 2/78.1 |
| 6,076,187 | A | | 6/2000 | Wallerstein | 2/115 |
| 6,817,034 | B2 | | 11/2004 | Smilovic | 2/73 |
| 6,836,903 | B1 | | 1/2005 | Goldstein | 2/69 |
| 7,395,557 | B1 | * | 7/2008 | Ledyard | 2/113 |
| 2003/0106130 | A1 | | 6/2003 | Reynolds | 2/69 |
| 2005/0177920 | A1 | | 8/2005 | Wilkinson | 2/69 |

FOREIGN PATENT DOCUMENTS

| | | |
|---|---|---|
| CH | 684380 | 9/1994 |
| WO | WO 94/05171 | 3/1994 |

* cited by examiner

*Primary Examiner* — Gary L Welch
*Assistant Examiner* — Amber Anderson
(74) *Attorney, Agent, or Firm* — Ernest D. Buff; Ernest D. Buff & Associates, LLC; Margaret A. LaCroix

(57) ABSTRACT

The shirt for supporting and shaping the mid-section of a wearer provides a shirt having a top-section and a mid-section. The mid-section of the shirt includes an upper and lower region each constructed having a plurality of fabric densities or integrated elasticity portions. These elasticity portions provide support for the abdominal region, back, and back-side regions of the wearer where "love handles" sometime develop. The top-section of the shirt has a substantially loose fitting construction to yield a simple, clean and comfortable fit that facilitates breath-ability and comfort to the wearer. The shirt may be worn as an undershirt or as outerwear to minimize the wearer's torso. In another embodiment, the shirt further comprises an outer portion that extends over and covers the mid-section so that the mid-section acts as an internal support structure when the shirt is worn as a T-shirt or outerwear.

12 Claims, 2 Drawing Sheets

SHIRT HAVING FORM-FITTING MID-SECTION SUPPORT

BACKGROUND OF THE INVENTION

1. Field of the Invention

The present invention relates to a shirt having a form-fitting mid-section; and more particularly, to a shirt adapted to support and shape the mid and lower torso of a wearer by providing upper and lower regions of the shirt's midsection with elasticity portions that support and minimize the appearance of the mid and lower torso.

2. Description of the Prior Art

Confidence is oftentimes affected by one's own perception of his or her physical body appearance. In today's fitness minded world one's physique plays an important role in the perception of his or her self-image. Various garments, both underwear and outerwear, have been provided in attempts to enhance a wearer's physical appearance and confidence. However, none of the garments heretofore disclosed and utilized provide the ability for a wearer to minimize his or her virtually entire mid-section area having a plurality of fabric densities that provide multifaceted support for the abdominal area, lower back, and torso sides.

Some garments heretofore utilized are simply constructed to prevent disheveling of the garment and to present a neat, clean unwrinkled appearance. These garments do not provide significant support to the body of the wearer, and they do not provide a minimizing or cinching affect. For example, U.S. Pat. No. 432,442 to Sanford discloses an undershirt having a bust portion, contracted waist portion, and a skirt portion having a vertically ribbed band provided at the lower end thereof to prevent the lower end of the skirt from working up-ward around the hip and seat portions of the body. U.S. Pat. No. 1,380,605 to Swantees discloses a lock garment, such as shirts for women's or men's wear generally including a connecting portion consisting of a single band to form a snug waistline so that the garment does not creep or slip above or below the wearer's waistline. Foreign Patent Publication No. WO94/05171 to Kooistra discloses a garment which is worn in the trousers or in the skirt, provided at its under-portion with a hip-fitting piece of elastic material in order to prevent the slipping out of trousers or skirt so that the garment remains neat and does not bunch up or become disheveled looking.

These existing garments do not provide the ability to minimize the wearer's waist-line or back. Instead, these garments provide portions that prevent the garment from creeping upward on a person's torso. Additionally, the portions are not integrated within the interstitials of a garment that can be worn as outerwear by the wearer. Rather, these garments are typically appointed to be worn as undergarments, worn under an outer garment.

Other garments provide elastic features built-in within the garment so that the garment is form-fitting in nature, and thus yields a leaner appearance to the wearer's physique, as well as to prevent unwanted shifting of the garment during wear. Elasticized form fitting garments are utilized, typically involving shirts or the like, appointed with discrete elastic portions woven within different sections thereof. For example, U.S. Pat. No. 6,076,187 to Wallerstein discloses an elasticized form fitting shirt having an overall outward appearance of a standard shirt but provided with a plurality of elastic stretchable elements woven in the side portions, concentrated at the lower sides, i.e., at the waist sides, of the shirt, and are preferably woven into the basic shirting material in a graduated pattern so as to blend in with the basic shirt and thus be inconspicuous. U.S. Pat. No. 2,456,190 to Heilbronner discloses a self-adjusting shirt having a main section with pendant front and rear portions appointed with elastic-knitted material inserts having a v-shape construction extending vertically from the arm pits to the waist to give elasticity cross-wise or about the body of the wearer so that the garment is fitted against the wearer's waist. U.S. Pat. No. 6,836,903 to Goldstein discloses a braided garment, shown as a shirt, wherein the shirt employs a braid located on both outer side surfaces to provide an attractive and decorative design and to provide expansion or contraction of the clothing, given the size and shape of the wearer. U.S. Patent Application Publication No. 2003/0106130 to Reynolds discloses body form-fitting rainwear having three-layers: an inner form-fitting fabric layer, a waterproof moisture vapor permeable hydrophobic layer, and an outer fabric layer.

Like the aforementioned garments appointed to prevent shifting upon the wearer's body, these elasticized form fitting garments generally provide elastic elements integrated into portions of the garment in order to shape and sculpt the garment, prevent bunching and creasing and provide a form-fitting appearance. Although the elastic elements are appointed to provide form-fitting of the garment onto the wearer's body, there is no indication that the elastic elements minimize the appearance of the wearer's torso and waist. Even still, the arrangement of the elasticized inserts or form-fitting fabric would not optimally facilitate rendering the appearance of a toned torso and waistline physique. Instead, it is likely that the wearer's abdominal and lower back are not tightly held, and may even cause certain less toned areas of the wearer's torso to slightly protrude from the confines of the form-fitting fabric, yielding discomfort and an unsightly bulgy appearance.

Still other support type garments provide toning body suits or the like that are adapted to render tension on the muscles of the wearer's body to facilitate toning of various muscle groups of the wearer. For example, U.S. Pat. No. 4,065,814 to Fox discloses a one piece elastic body suit appointed with an elastic waist and elongated elastic band members extending vertically over the length of the suit and over the shoulders and being attached to feet straps so that band members are placed under tension exerted by the feet of the wearer thereby exerting pressure on the muscles of the body. U.S. Pat. No. 6,053,852 to Wilkinson discloses a body suit having a shirt portion and pants portion joined together by an elastic abdominal ring that applies a longitudinal resistance force in response to movement of the body. Foreign Patent Publication No. CH684380 to Pejic et al. discloses an orthopedic T-shirt having an elastic band that is fitted on the inside in the shoulder region so that extension force of the elastic band indicates change in the correct positioning of the shoulder.

Body suits or garments such as these cannot be utilized as outerwear, nor can these body suits or garments be comfortably worn as an undergarment on a daily basis. Rather, these body suits and garments are appointed to be worn when a wearer desires to apply tension to his or her muscles in an attempt to tone their musculature as pressure is applied to the legs, back and shoulders, or when a wearer needs therapeutic treatment for his or her back. Extended wear of the body suit is not practical as wearing of the suit should typically only be done when the wearer intends to work their muscles. Elongated elastic bands are typically provided by these types of garments in order to cause resistance to the person's body in order to stimulate toning and strengthening of the body; the elongated bands or horizontal band of the orthopedic shirt do not function to minimize or cinch the torso of the wearer's body, and in fact may cause bulging thereof due to the arrangement of the elastic band or bands.

Support and shaping of a wearer's torso is intended by variously utilized garments. For example, maternity garments and garments for woman have been utilized to attempt to smooth and shape a woman's figure. These garments are designed for woman, and generally provide undergarments to be worn on the woman's torso, resembling a bodice type garment. See, U.S. Pat. No. 6,817,034 to Smilovic teaches a maternity undergarment that envelopes the woman's bust, torso, and thighs wherein the torso is elastically enwrapped by a torso section adapted to provide for the changing proportions of her abdomen by providing different stretch characteristics therein; shaping of the back, waist and around the buttocks is also provided. Although these maternity garments provide stretch fabric appointed to support and smooth the torso, the belly section is stretchable to accommodate the growing pregnant woman's belly. The entire waist-line and torso of the wearer is not ensconced in the support fabric, and though support is give, the garment does not minimize the body, but merely supports same.

Likewise, a number of garments are provided that attempt to smooth and shape a wearer's waist by providing an elastic waistband appointed with a tensioning system, such as a belt or strap. For example, U.S. Patent Application Publication No. 2005/0177920 to Wilkinson discloses a garment for supporting and shaping the mid-section of a wearer by providing a wide elastic waistband extending from below the wearer's rib cage to the belly button, wherein the waistband is further appointed with an adjustable tensioning system, such as a strap or belt. The tensioning system required by these shape smoothing garments typically incorporate loops or rings and straps which can be adjustably manipulated in order to control the tension applied at the abdominal section. The elastic waistband and tensioning system disclosed by these shape smoothing garments cannot be readily worn inconspicuously as the tension system can be bulky to hide under another garment. In addition, the elastic waistband and tensioning system of these types of shape smoothing garments are located at the waist of the wearer, and as such merely minimize the waist and a portion of the lower back at best.

Notwithstanding the efforts of prior art workers to construct a support garment, there remains a need in the art for a shirt adapted to support and shape the mid-section of a wearer, and which comprises a mid-section having an upper and lower region interstitially constructed therein. In addition, there is a need in the art for a shirt wherein the upper and lower torso of a wearer are supported by a form-fitting mid-section of the shirt; wherein upper and lower regions of the shirt comprise a plurality of fabric densities or integrated elasticity portions that provide multifaceted support for the abdominal area, lower back, and torso sides of the wearer. Moreover, there is a need in the art for a shirt adapted to support and shape the mid-section of a wearer, and which comprises a top-section having a simple, clean, substantially loose fitting and comfortable construction that affords breathability and comfort when worn.

SUMMARY OF THE INVENTION

The present invention provides a shirt adapted to support and shape the mid-section of a wearer. Such a shirt comprises a mid-section constructed with an upper and lower region having a plurality of integrated material densities via elasticity portions. Differing material densities of the shirt provide tailored support and minimize discrete regions within the torso area of the wearer, including: (i) the abdominal region; (ii) lower back; and (iii) side regions, where "love handles" oftentimes develop. Moreover, the shirt for supporting and shaping the mid-section of a wearer further provides a top-section that has a substantially loose fitting construction. The top section provides a simple, clean, and comfortable fit that facilitates breath-ability and comfort when worn.

In one embodiment, the invention provides a shirt for supporting and shaping the mid-section of a wearer. The shirt comprises a top-section, a mid-section further and upper and lower regions. The mid-section is composed of material that is sized and shaped to fit the wearer's mid and lower torso. Moreover, the mid-section material of the shirt is provided with durability and strength, enabling it to act as a minimizer, causing the size and shape of the wearer's mid and lower torso to be supported and minimized. In addition, the upper and lower regions of the mid-section are composed of at least one upper elasticity portion and at least one lower elasticity portion, respectively.

In another embodiment, the invention provides a shirt for supporting and shaping the mid-section of a wearer, wherein the shirt construction comprises a top-section, a mid-section, upper and lower regions, and an outer portion. The mid-section is composed of a material that enables the mid-section to form-fit the mid and lower torso of a wearer when the shirt is worn. Moreover, the mid-section is of such durability and strength that it acts as a minimizer, causing the wearer's mid and lower torso to be supported and minimized in size and shape. The upper and lower regions of the mid-section are composed of at least one upper elasticity portion and at least one lower elasticity portion, respectively. In addition, the outer portion extends over and covers the mid-section so that the mid-section is not visible to the public. As a result, the mid-section acts as an internal support structure when the shirt is worn as a T-shirt or outer garment.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention relates to a shirt for supporting and shaping the mid-section of a wearer wherein the shirt is provided with a form-fitting mid-section constructed with an upper and lower region each appointed with a plurality of integrated material densities or elasticity portions. These differing material densities or elasticity portions render optimal minimization to the torso area of the wearer. As a result, the abdominal region, lower back, and side regions where "love handles" accumulate, are each minimized so that the wearer's body projects a more toned appearance. The top-section of the shirt for supporting and shaping the mid-section of a wearer has a substantially loose fitting construction that yields a simple, clean and comfortable fit, affording breathability and comfort.

The shirt for supporting and shaping the mid-section of a wearer minimizes certain problems associated with a person's mid-section area. Advantageously, the shirt for supporting and shaping the mid-section of a wearer provides the ability for a wearer to minimize his or her mid-section area while at the same time providing a top-section that is loose and comfortable. The shirt for supporting and shaping the mid-section of a wearer is particularly well suited for use by men; but can be gender neutral. In particular, the mid-section area of the shirt is adapted to minimize and support "problem" areas, such as the stomach and the lower back, where "bellies" and "love handles" are prone to develop.

Figure 1:
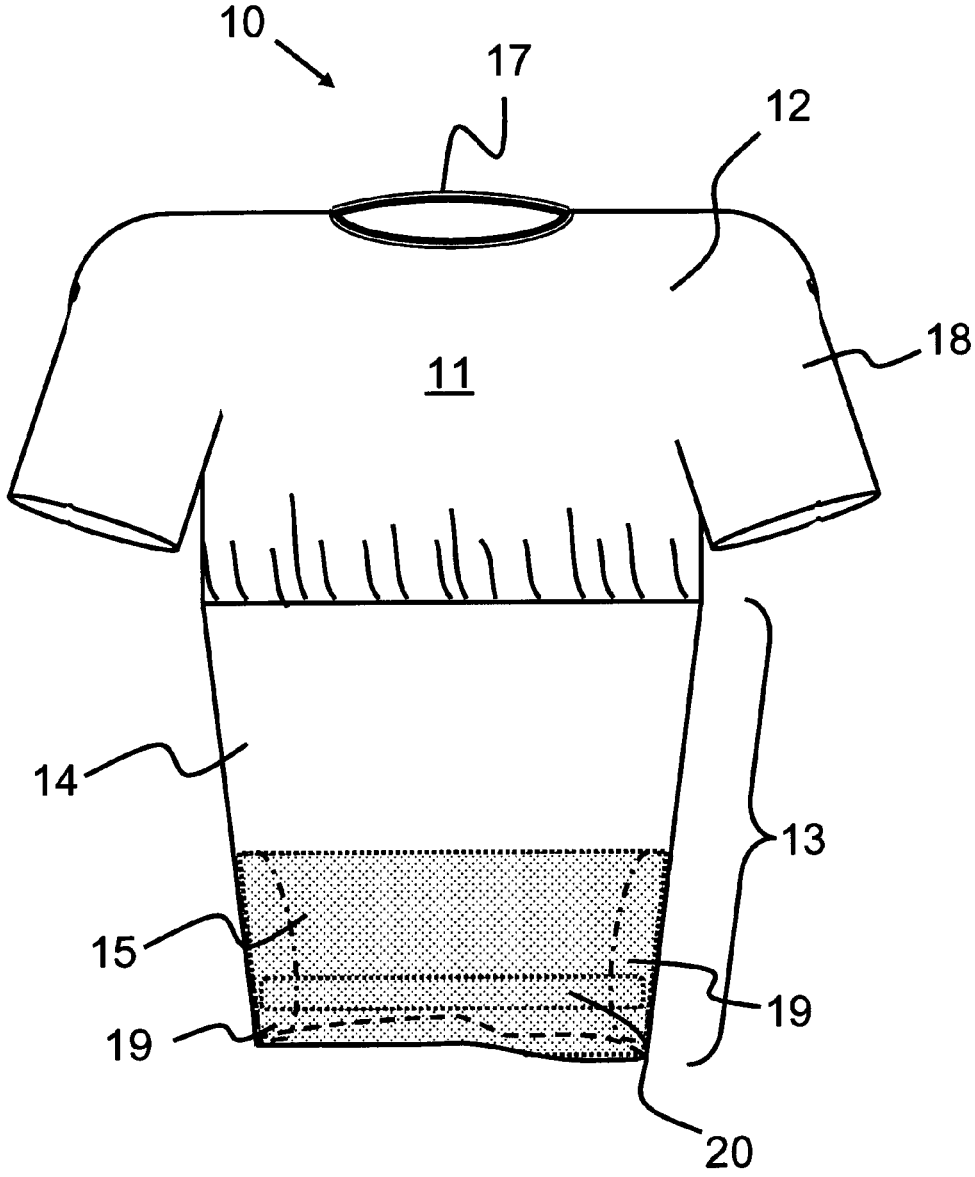
FIG. 1 illustrates a schematic view of an embodiment of the shirt for supporting and shaping the mid-section of a wearer.

FIG. 1 illustrates a schematic view of an embodiment of the shirt for supporting and shaping the mid-section of a wearer, shown generally at 10. The shirt for supporting and shaping the mid-section of a wearer 10 comprises a shirt 11 having a top-section 12, appointed with a collar 17 and sleeves 18, and a mid-section 13. Mid-section 13 is composed of a material so that the mid-section 13 is form-fitting to a mid and lower torso of a person when shirt 11 is worn. In this embodiment, the shirt for supporting and shaping the mid-section of a wearer 10 is preferably worn as an undergarment, but may be worn as a regular T-shirt (or as outerwear; See FIG. 2 discussed hereinbelow). Preferably, the material of mid-section 13 comprises an elasticized material of durable strength so that mid-section 13 is form-fitting to the wearer's body. As a result, the mid-section 13 conforms to the mid and lower torso of the wearer's body. In doing so, the mid-section 13 supports and cinches the wearer's waist, minimizing its perceived size and enhancing the wearer's appearance.

Continuing with FIG. 1, mid-section 13 further comprises an upper region 14 and a lower region 15. Upper region 14 is composed of at least one upper elasticity portion. This at least one upper elasticity portion of upper region 14 is preferably composed of a fibrous material having elastic properties. Upper region 14 may be composed of a plurality of upper elasticity portions so that the upper region 14 has a graduated nature; that is to say, that the upper elasticity portions may be of the same elastic nature, or they may vary gradually, increasing in elastic strength or increasing in fibrous density to form a gradual increase in strength as the upper region 14 extends downwardly toward the lower region 15.

Lower region 15 of mid-section 13 is shown as a shaded region. Lower region 15 is composed of at least one lower elasticity portion. Lower elasticity portion of lower region 15 is composed of a fibrous material having substantially enhanced elastic properties. Lower region 15 is provided with increased elasticity via lower elasticity portion for enhanced minimization and support of the lower torso of a person wearing the shirt 11, thereby focusing in on the problem area associated with back sides of a wearer's torso, including "love handles". Preferably lower elasticity portion of lower region 15 is composed of a fibrous material having substantially enhanced elastic properties that provide greater support strength than the upper elasticity portion of upper region 14 of mid-section 13. Lower elasticity portion of lower region 15 may be composed of a cotton material or lining.

Enhanced elasticity of the lower region 15 can further be facilitated by providing the sides of lower region 15 of mid-section 13 with lateral portions 19, preferably being composed of a cotton lining. Lateral portions 19 are placed in the general region of the "love-handle" area, to provide additional support thereto. Alternatively, enhanced elasticity of the lower region 15 can be achieved by providing lateral portions 19 with an additional elastic tube or band 20 to cinch and support the "love-handle" area. Preferably, mid-section 13 is about ½ size smaller than the top-section 12 of the shirt for supporting and shaping the mid-section of a wearer 10. For a man's shirt 11, the mid-section 13 preferably begins at least one inch from below the chest or nipple area; preferably, mid-section 13 begins at 2 inches below the chest or nipple area. The top-section 12 of shirt 11 is composed of a high quality cotton material, which allows the body to breath and provides comfort to the wearer so that the wearer can move freely during daily activity without feeling constricted.

Lower region 15 is composed of at least one lower elasticity portion. This at least one lower elasticity portion of lower region 15 is preferably composed of a fibrous material having elastic properties. Lower region 15 may be composed of a plurality of lower elasticity portions so that the lower region 15 has a graduated nature; that is to say, that the lower elasticity portions may be of the same elastic nature, or they may vary gradually, increasing in elastic strength or increasing in fibrous density to form a gradual increase in strength as lower region 15 extends downwardly. As a result, the wearer's body projects a desirable appearance, which more closely approximates a triangular shape, extending from the chest cavity to the waist line.

Figure 2:
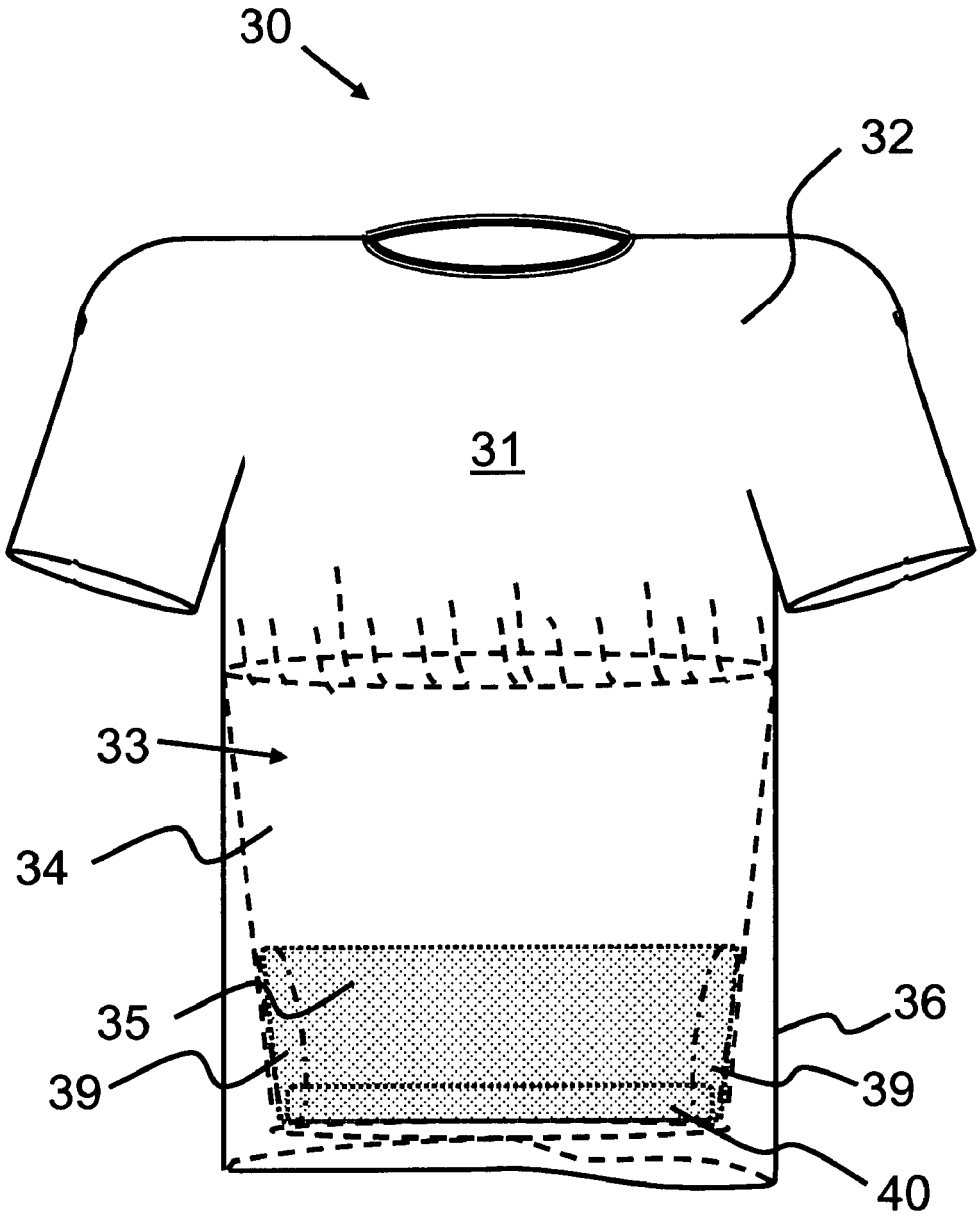
FIG. 2 illustrates a schematic view of another embodiment of the shirt for supporting and shaping the mid-section of a wearer.

FIG. 2 illustrates a schematic view of another embodiment of the shirt for supporting and shaping the mid-section of a wearer, shown generally at 30. The shirt for supporting and shaping the mid-section of a wearer 30 comprises a shirt 31 having a top-section 32 and a mid-section 33. In FIG. 2, mid-section 33 is under an outer portion 36 so that mid-section 33 is not visible to the public and thereby acts as an internal support structure when shirt 31 is worn as a T-shirt or outer wear. Mid-section 33 is composed of a material, preferably being an elastic material, so that mid-section 33 is form-fitting to a mid and lower torso of a person when shirt 31 is worn. The elasticized material composing mid-section 33 is durable and form-fitting so that the mid-section 33 conforms to the mid and lower torso of the person's body and supports and minimizes same in size and appearance.

Mid-section 33 further comprises an upper region 34 and a lower region 35. Upper region 34 is composed of at least one upper elasticity portion. The at least one upper and or lower elasticity portions of upper region 34 and lower region 35 are preferably composed of a fibrous material having elastic properties. Upper region 34 and/or lower region 35 may be composed of a plurality of upper or lower elasticity portions, respectively, so that the upper region 34 and/or lower region 35 have a graduated nature; that is to say, that the upper and or lower elasticity portions may be of the same elastic nature, or they may vary gradually, increasing in elastic strength or increasing in fibrous density to form a gradual increase in strength as the upper and lower regions 34 and 35 extend downwardly.

Lower region 35 is shown as a shaded region. Lower region 35 is composed of at least one lower elasticity portion. Lower elasticity portion of lower region 35 is composed of a fibrous material having substantially enhanced elastic properties. Lower region 35 is provided with increased elasticity via lower elasticity portion for enhanced minimization and support of the lower torso of a person wearing the shirt 31, thereby focusing in on the problem area associated with back sides of a wearer's torso, including "love handles". Preferably lower elasticity portion of lower region 35 is composed of a fibrous material having substantially enhanced elastic properties that provide greater support strength than the upper elasticity portion of upper region 34 of mid-section 33. Lower elasticity portion of lower region 35 may be composed of a cotton material or lining. Enhanced elasticity of the lower region 35 can further be facilitated by providing the sides of lower region 35 of mid-section 33 with lateral portions 39, preferably being composed of a cotton lining. Lateral portions 39 are placed in the general region of the "love-handle" area, to provide additional support thereto. Alternatively, enhanced elasticity of the lower region 35 can be achieved by providing lateral portions 39 with an additional elastic tube or band 40 to cinch and support the "love-handle" area.

Lower region 35 is provided with enhanced elasticity for enhanced minimization and support of the lower torso of the person wearing the shirt 31, thereby focusing in on the problem area associated with "love handles". The top-section 32 and outer portion 36 of shirt 31 are composed of a high quality cotton material, which allows the body to breath and provides comfort to the wearer so that the wearer can move freely during daily activity without feeling constricted. Outer portion 36 hides mid-section 33 so that the wearer can wear the shirt as a T-shirt or as outer wear with confidence.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A shirt for supporting and shaping the mid-section of a wearer, comprising:

a. a top-section;

b. a mid-section composed of a material constructed to cause said mid-section to be formfitting with a mid and lower torso of said wearer when said shirt is worn, said midsection having sufficient durability and strength to be operable as a minimizer, causing said wearer's mid and lower torso to be supported and minimized in size and shape;

c. said mid-section further comprising an upper region and a lower region wherein said upper region is composed of at least one upper elasticity portion and said lower region is provided with at least one lower elasticity portion;

d. said at least one upper elasticity portion of said upper region and said at least one lower elasticity portion of said lower region of said mid-section are composed of a fibrous material having substantially elastic properties;

e. said lower region of said mid-section further comprising lateral portions;

f. said lateral portions of said lower region of said mid-section being composed of a cotton lining; and g. wherein said mid-section is at least ½ size smaller than said top-section.

2. A shirt for supporting and shaping the mid-section of a wearer as recited by claim 1, wherein said top-section is composed of a cotton material and is substantially loose fitting.

3. A shirt for supporting and shaping the mid-section of a wearer as recited by claim 1, wherein said upper region is composed of a plurality of said upper elasticity portions; preferably said plurality of said upper elasticity portions are each composed of differing fibrous or elastic strength so that said strength of said upper elasticity portions of said upper region are graduated in nature, increasing in said elastic strength to form a gradual increase as said upper region extends downwardly toward said lower region.

4. A shirt for supporting and shaping the mid-section of a wearer as recited by claim 1, wherein said at least one lower elasticity portion of said lower region is composed of a fibrous material having substantially enhanced elastic properties and wherein said fibrous material having substantially enhanced elastic properties of said lower elasticity portion has greater support strength than said at least one upper elasticity portion of said upper region of said mid-section.

5. A shirt for supporting and shaping the mid-section of a wearer as recited by claim 1, wherein said lateral portions of said lower region of said mid-section are provided with an additional elastic tube or band.

6. A shirt for supporting and shaping the mid-section of a wearer as recited by claim 1, wherein said lower region is composed of a plurality of said lower elasticity portions; preferably said plurality of said lower elasticity portions are each composed of differing fibrous or elastic strengths so that said strengths of said lower elasticity portions of said lower region becomes graduated in nature, said elastic strengths gradually increasing as said lower region extends downwardly.

7. A shirt for supporting and shaping the mid-section of a wearer, comprising:

a. a top-section;

b. a mid-section composed of a material constructed to cause said mid-section to be formfitting with a mid and lower torso of said wearer when said shirt is worn, said midsection having sufficient durability and strength to be operable as a minimizer, causing said wearer's mid and lower torso to be supported and minimized in size and shape;

c. said mid-section further comprising an upper region and a lower region wherein said upper region is composed of at least one upper elasticity portion and said lower region is provided with at least one lower elasticity portion;

d. said at least one upper elasticity portion of said upper region and said at least one lower elasticity portion of said lower region of said mid-section being composed of a fibrous material having substantially elastic properties;

e. said lower region of said mid-section further comprising lateral portions;

f. said lateral portions of said lower region of said mid-section being composed of a cotton lining; and g. wherein said shirt comprises a chest area and wherein said mid-section begins at least one inch from below said chest area.

8. A shirt for supporting and shaping the mid-section of a wearer as recited by claim 7, wherein said top-section is composed of a cotton material and is substantially loose fitting.

9. A shirt for supporting and shaping the mid-section of a wearer as recited by claim 7, wherein said upper region is composed of a plurality of said upper elasticity portions; preferably said plurality of said upper elasticity portions are each composed of differing fibrous or elastic strength so that said strength of said upper elasticity portions of said upper region are graduated in nature, increasing in said elastic strength to form a gradual increase as said upper region extends downwardly toward said lower region.

10. A shirt for supporting and shaping the mid-section of a wearer as recited by claim 7, wherein said at least one lower elasticity portion of said lower region is composed of a fibrous material having substantially enhanced elastic properties and wherein said fibrous material having substantially enhanced elastic properties of said lower elasticity portion has greater support strength than said at least one upper elasticity portion of said upper region of said mid-section.

11. A shirt for supporting and shaping the mid-section of a wearer as recited by claim 7, wherein said lateral portions of said lower region of said mid-section are provided with an additional elastic tube or band.

12. A shirt for supporting and shaping the mid-section of a wearer as recited by claim 7, wherein said lower region is composed of a plurality of said lower elasticity portions; preferably said plurality of said lower elasticity portions are each composed of differing fibrous or elastic strengths so that said strengths of said lower elasticity portions of said lower region becomes graduated in nature, said elastic strengths gradually increasing as said lower region extends downwardly.

* * * * *